US006981463B1

(12) United States Patent
Aichele

(10) Patent No.: US 6,981,463 B1
(45) Date of Patent: Jan. 3, 2006

(54) BOW EYE SEAL

(75) Inventor: Fredric J. Aichele, Fort Wayne, IN (US)

(73) Assignee: EPCO Products, Inc., Fort Wayne, IN (US)

( * ) Notice: Subject to any disclaimer, the term of this patent is extended or adjusted under 35 U.S.C. 154(b) by 0 days.

(21) Appl. No.: 10/946,469

(22) Filed: Sep. 21, 2004

(51) Int. Cl.
*B63B 21/04* (2006.01)

(52) U.S. Cl. ..... 114/218; 114/364; 114/343

(58) Field of Classification Search ..... 114/343, 114/364, 218; 411/147–165, 371.1, 542; 277/592, 606, 628
See application file for complete search history.

(56) References Cited

U.S. PATENT DOCUMENTS

| | | | | |
|---|---|---|---|---|
| 2,904,354 A | * | 9/1959 | Kifer | 285/43 |
| 2,982,573 A | * | 5/1961 | McKee, Jr. | 411/542 |
| 3,126,859 A | * | 3/1964 | Bigelow | 114/218 |
| 3,202,033 A | * | 8/1965 | Weidner, Jr. | 411/371.1 |
| 3,765,365 A | | 10/1973 | Gillespie | 114/218 |
| 3,863,588 A | | 2/1975 | Gillespie | 114/218 |
| 4,200,944 A | | 5/1980 | Gillespie et al. | 9/1.1 |
| 5,134,964 A | | 8/1992 | Masters | 114/347 |
| 5,197,406 A | | 3/1993 | Rabal et al. | 114/363 |
| 5,265,552 A | | 11/1993 | Taylor | 114/219 |
| 5,291,845 A | | 3/1994 | Vallery | 114/203 |

* cited by examiner

*Primary Examiner*—Ed Swinehart
(74) *Attorney, Agent, or Firm*—Baker & Daniels LLP

(57) ABSTRACT

A bow eye for marine use including a U-shaped bolt having two threaded legs. Two metal plates are located respectively on either side of a watercraft hull. A first pair of nuts are threaded onto the legs with one plate being positioned adjacent the nuts. A second pair of nuts is used to secure the bow eye to the hull. A sealing gasket is located on the side of the outside plate that is between the outside plate and the hull. The sealing gasket has apertures that are smaller than apertures located in the hull. The gasket apertures are smaller than the diameter of the legs causing the gasket to pucker around the legs when mounted on the legs. When the bow eye legs are inserted into the hull, the puckered portion of the gasket partially fills the hull apertures. The bow eye nuts are tightened, forcing the gasket further into the hull apertures to seal the bow eye in the hull.

5 Claims, 4 Drawing Sheets

BOW EYE SEAL

BACKGROUND OF THE INVENTION

1. Field of the Invention

The present invention relates to a bow eye having sealing means for sealing the bow eye in the hull of the watercraft.

2. Description of the Related Art

Lifting eyes, stern eyes, and bow eyes are commonly used on watercrafts to provide securing means for ropes and cables used to tie the boat to a dock, tow other boats, anchor tie-offs, pull skiers or for lifting the boat from the water. Lifting and bow eyes are described in U.S. Pat. Nos. 3,765,365 and 3,863,588 to Gillespie and 4,200,944 to Gillespie et al., the disclosures of which are hereby expressly incorporated herein by reference.

More specifically, bow eyes are typically U-shaped bolts having a pair of threaded legs. A significant portion of the bow eye legs is threaded such that the entire portion of the legs passing through the watercraft is threaded. A first nut is threaded onto each of the leg portions. A bow eye plate with through holes is mounted on the bow eye behind the first nuts, and the bolt is inserted through apertures in the hull of the watercraft. A second bow eye plate may be mounted on the bow eye from the inside of the hull and then a second nut is threaded onto the free, inner ends of each of the leg portions and is tightened to secure the bow eye to hull of the watercraft.

When installing the bow eye onto a watercraft, the apertures in the hull are typically larger than the outer diameter of the bow eye legs and thus, water may leak into the watercraft through the apertures. In some prior art embodiments, caulking material has be used to seal the open areas around the threaded portions of the bow eye where the bow eye goes through the hull. The caulking material may be applied to the bow eye plate. In addition, the caulking material may be placed in the apertures in the hull through which the legs of the bow eye are inserted. Alternatively, the caulking material may be applied to the bow eye itself. In additional, the bow eye may be sealed with caulking material after the bow eye is installed.

A problem with using caulking material to seal a bow eye is that the caulking material must be installed by hand, leaving open the possibility that the apertures are not completely sealed. In addition, the life span of the caulking material may be unreliable. The caulking material may become old, drying out or cracking, thus requiring the aperture to be resealed repeatedly. Further, the caulking material may become a host for foreign material which may cause a discoloration to the hull of the boat. Some forms of caulking material omit fumes that are undesirable and may cause discomfort for those exposed to the fumes. Caulking material may also exhibit different cure times due to ambient conditions.

After a bow eye has been installed with caulking material, removal of the bow eye is an extensive, time consuming and expensive process. The bow eye component must be thoroughly cleaned before being re-installed and the mounting area in the hull must be prepared to accept the new installation.

Referring to FIG. 8, bow eye 40 illustrates a prior art bow eye. Bow eye 40 includes U-shaped bolt 42 having threaded legs 44. Protrusions 46 are formed at the upper portions of legs 44. A solid rubber member 48 is a one piece member having a plate (not shown) molded therein. Member 48 is mounted on legs 44 and is positioned such that extended portions 50 of member 48 engage protrusions 46. Member 48 is shown with extended portions 50 positioned below protrusions 46 for illustration purposes. U-shaped bolt 42 and member 48 are a complete sub-assembly with member 48 being securely held in place on bolt 42 by engagement of extended portions 50 on protrusions 46. When bow eye 40 is mounted to the hull of a boat, lower surface 52 of member 48 engages the surface of the hull to seal bow eye 40 to the hull. Plate 54 is then placed on legs 44 and a pair of nuts 56 is threaded onto legs 44 to secure the position of bow eye 40.

Problems exist with member 48 that are similar to those of the caulking material. For example, rubber member 48 may become old and cracked, requiring bow eye 40 to be removed and the sub-assembly consisting of U-shaped bolt 42 and member 48 to be replaced.

It is desired to provide a seal for sealing the bow eye in the hull of a watercraft that is dependable and easy to install.

SUMMARY OF THE INVENTION

The present invention provides a bow eye for marine use. The bow eye includes a U-shaped bolt having two threaded legs. Two metal plates are provided that are located respectively on either side of the hull material of the watercraft. A first pair of nuts are threaded onto the bow eye legs to the full extent of the threaded portion of the bow eye legs with one plate being positioned adjacent to the installed nuts. The plate is located on the external surface of the hull of the watercraft. A second pair of nuts is used to secure the bow eye to the hull. The metal plate that is on the inside of the watercraft may be optional for certain uses so that only a pair of nuts is used on the inside of the hull.

In the present invention, the caulking material typically used to seal apertures in the hull is replaced by a gasket that is affixed to the outside metal plate and the hull. The gasket is a unitary piece constructed from a foam material. The apertures in the gasket material through which the bow eye legs pass are smaller than the apertures in the hull and smaller in diameter than the outer diameter of the bow eye legs. Alternatively, the gasket may be provided with a pair of bisecting cuts, which replace the gasket aperture, to provide an opening in the gasket. The length of each cut is substantially equal to that of the diameter of the aperture in the previous embodiment. When the bow eye plate having the gasket affixed thereto is pushed onto the legs of the bow eye, the gasket will pucker slightly toward the gasket side of the plate. When the bow eye legs are inserted into the hull, the puckered portion of the gasket will at least partially fill the apertures in the hull. Once the nuts of the bow eye on the inside of the hull are tightened, the gasket is forced further into the hull apertures to seal the bow eye in the hull.

The present invention comprises, in one form thereof, a bow eye for mounting on a rigid, substantially planar surface. The bow eye includes a rigid U-shaped bolt having a pair of threaded legs with at least one plate assembled with the legs. A sealing gasket is mounted to the plate. A first and second pair of nuts is removably mounted on each of the legs with the nuts securing the U-shaped bolt to the substantially planar surface, such that the gasket is compressed and sealingly secures the bow eye on the planar surface.

The present invention comprises, in another form thereof, a bow eye for mounting on a watercraft. The bow eye includes a rigid U-shaped bolt having a pair of threaded legs, and at least one plate mounted on the legs. A gasket is secured to the plate. A first and second pair of nuts is removably mounted on each of the legs. A pair of apertures is located in the watercraft and the legs are received in the apertures. The first and second pairs of nuts are used to secure the U-shaped bolt to the watercraft such that the gasket is sealingly compressed into the apertures.

An advantage of the present invention is that the bow eye is effectively sealingly secured to a watercraft. A further advantage of the present invention is that installation of the bow eye is simplified with the sealing method of the present invention.

A still further advantage of the present invention is that the dependability of the seal is improved.

Another advantage of the present invention is that there are no fumes from the use of caulking material to seal the bow eye in the hull. Further, there is no required cure time as with caulking material before insuring a seal. Additionally, there is no installation clean up required for caulking material that may extrude on to the surface of the hull or on the bow eye components.

A further advantage of the present invention is that the gasket material does not dry out or crack, and thus does not require that the gasket material be replaced. The gasket material is also flexible enabling it to fill irregularities that may exist at the apertures.

Another advantage of the present invention is that if the bow eye must be removed, the extensive, time consuming and expensive cleaning process required when using caulking material is eliminated.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
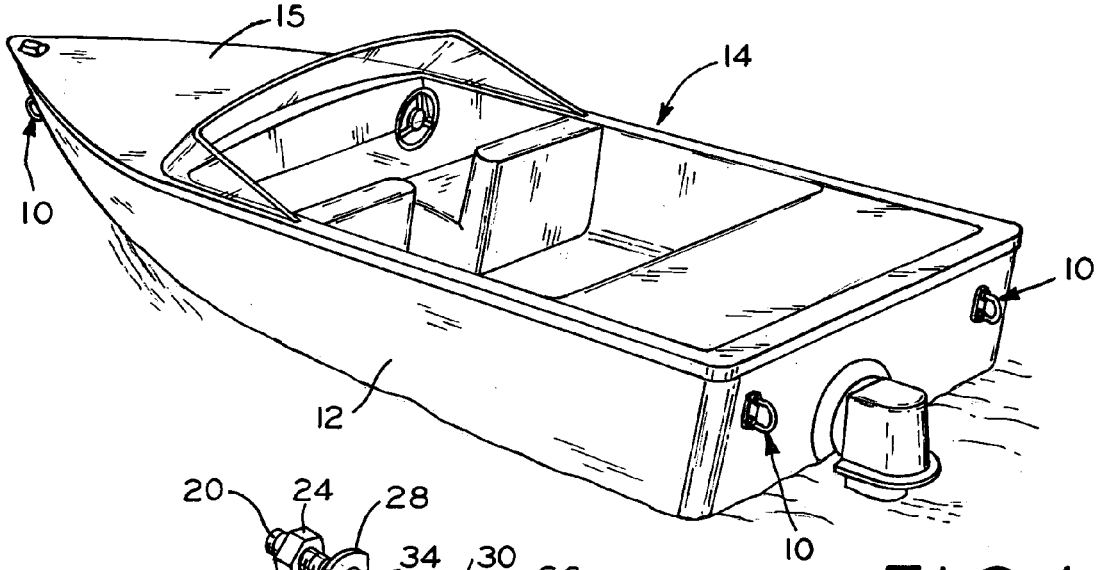
FIG. 1 is a perspective view of a boat having bow eyes mounted thereon in accordance with the present invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise forms disclosed.

DESCRIPTION OF THE PRESENT INVENTION

Referring to FIG. 1, bow eyes 10 are mounted at various locations on the bow and stern of watercraft 14. Although it is not shown, bow eye 10 may also be mounted to the upper deck 15 of boat 14 if desired. In the illustrated embodiment, watercraft 14 is a boat, however, it is understood that bow eye 10 may be mounted to any type of watercraft. Depending on the location of bow eye 10, bow eyes may be used for any suitable purpose including tying boat 14 to a dock, towing a skier, supporting an anchor, or lifting boat 14 from the water.

Figure 2:
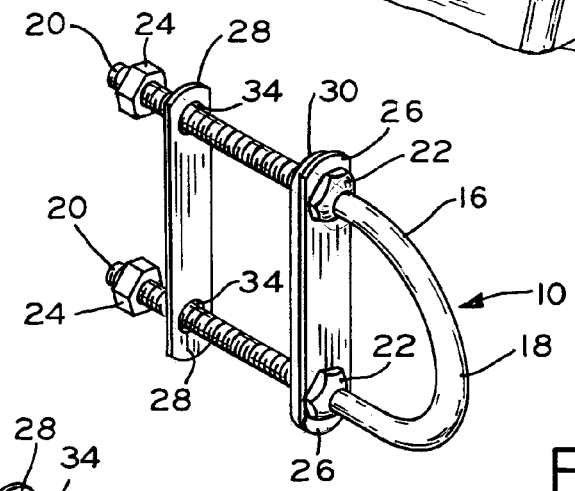
FIG. 2 is a perspective view of a bow eye in accordance with the present invention.
Figure 3:
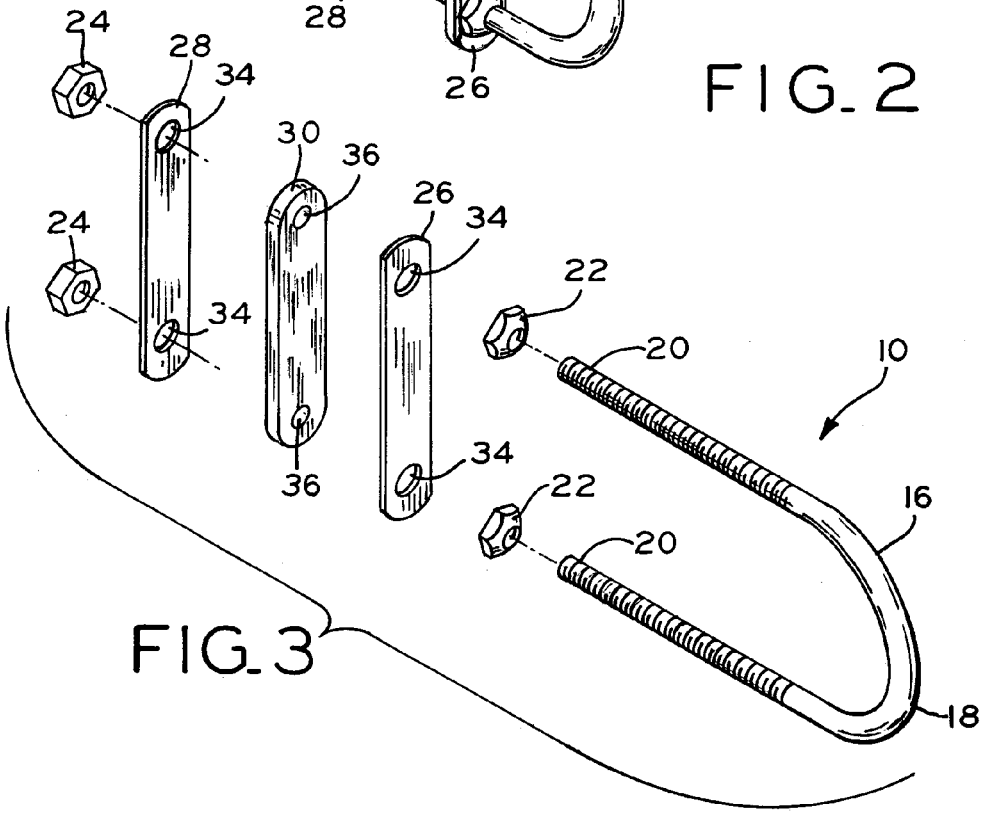
FIG. 3 is an exploded perspective view of the bow eye of FIG. 2 prior to affixation of the sealing gasket to one of the bow eye plates.
Figure 4:
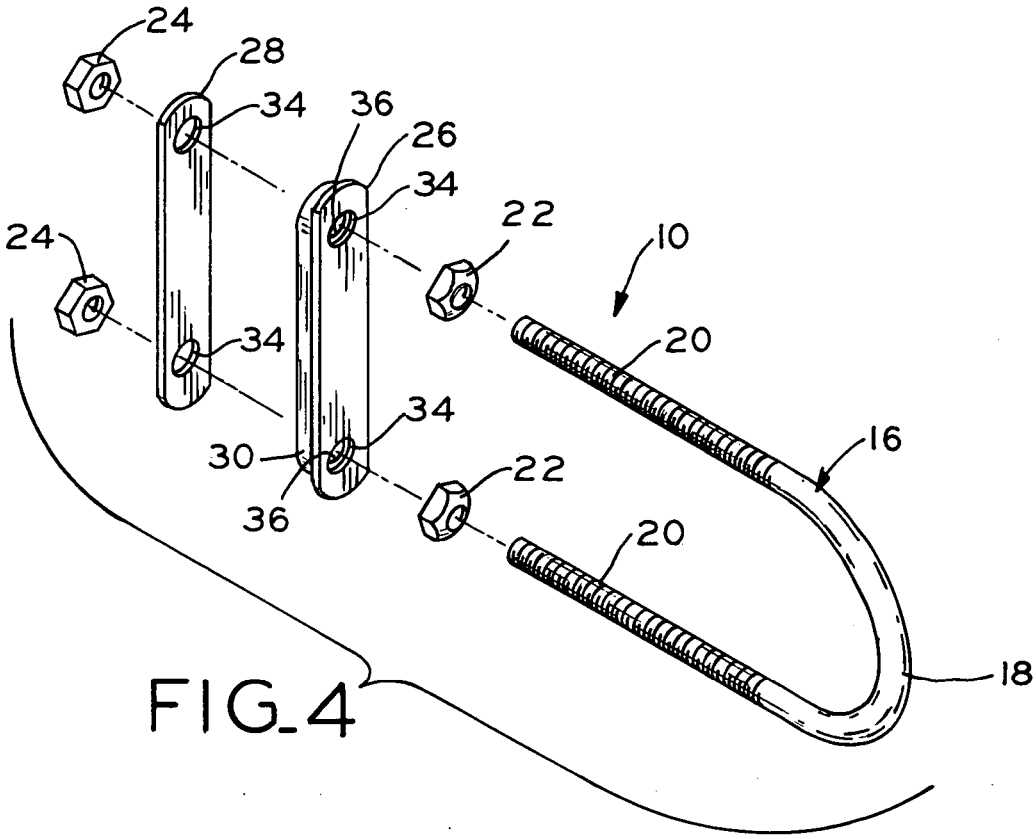
FIG. 4 is an exploded perspective view of the bow eye of FIG. 2 after the sealing gasket has been affixed to one of the bow eye plates.
Figure 8:
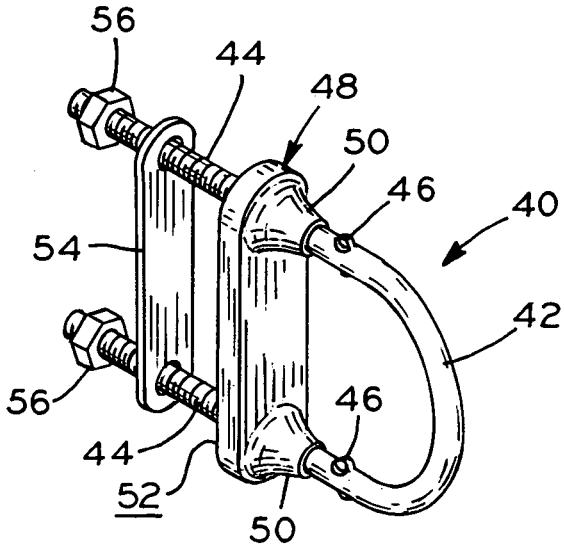
FIG 8 PRIOR ART
FIG. 8 is a perspective view of a bow eye in accordance with the prior art.

Referring to FIGS. 2, 3, and 4, bow eye 10 is mounted in a hull 12 of boat 14 and includes a conventional U-shaped bolt 16. Bolt 16 may be constructed from any suitable material able to withstand the loads applied to bow eye 10 and the environmental conditions to which it is exposed such as, for instance, stainless steel. Bolt 16 has a pair of legs 20 integrally linked by curved portion 18. Alternatively, legs 20 do not have to be connected by a curved portion 18. For example, a substantially rectangular or triangular shaped portion may integrally connect legs 20. Legs 20 are threaded substantially the entire length thereof. A first pair of nuts 22 and a second pair of nuts 24 are threaded onto legs 20 to secure bow eye 10 to boat hull 12.

Also mounted on legs 20 are a pair of metal plates 26 and 28 which are interposed between the respective pairs of nuts 22 and 24 and the interior and exterior surfaces of hull 12. Plates 26 and 28 provide load bearing surfaces for nuts 22 and 24 when bow eye 10 is mounted to boat 14. Plates 26 and 28 further distribute forces applied to bow eyes 10 when rope loads from mooring, anchors, or the like are applied to the bow eye. Plate 28 on the inside of boat 14 may be eliminated for certain uses so that only the pair of nuts 24 is used on the inside of hull 12. Plates 26 and 28 are typically constructed from stainless steel material and may be formed by any suitable method of construction including stamping, for example. The stainless steel plates may be polished to improve the aesthetic appeal of the plates on the external surface of boat 14. In addition, plates 26 and 28 may be any suitable shape including having flanged portions for tying off ropes, for example.

Secured to exterior plate 26 is gasket 30 that provides a seal between bow eye 10 and hull 12. Gasket 30 is a marine sealant constructed from a suitable foam material by any suitable method including being die cut. More specifically, the sealant used for gasket 30 may be a closed cell silicone sponge tape. One particular type of material that may be used to form gasket 30 is a sealing material or sealant or silicone tape from Kelcom Inc., 21419 Protecta Drive, Elkhart, Ind. One type of marine sealing material sold by Kelcom Inc. is silicone tape, the KS600 Series. The silicone tape is a pre-compressed, adhesive backed sealant that provides an impermeable barrier to the external environment, preventing infiltration of environmental forces into boat 14.

Gasket 30 is fixedly secured to exterior plate 26 by any suitable method. One such method may be to provide gasket 30 with an adhesive backing. The adhesive located on gasket 30 would be covered with a protective, reasonable, disposable layer which is removed to expose the adhesive. The gasket 30 is then adhered to a plate 26. Alternatively, adhesive used to secure gasket 30 to plate 26 may be applied to either gasket 30 or plate 26 during installation of bow eye 10 onto boat 14.

Figure 5:
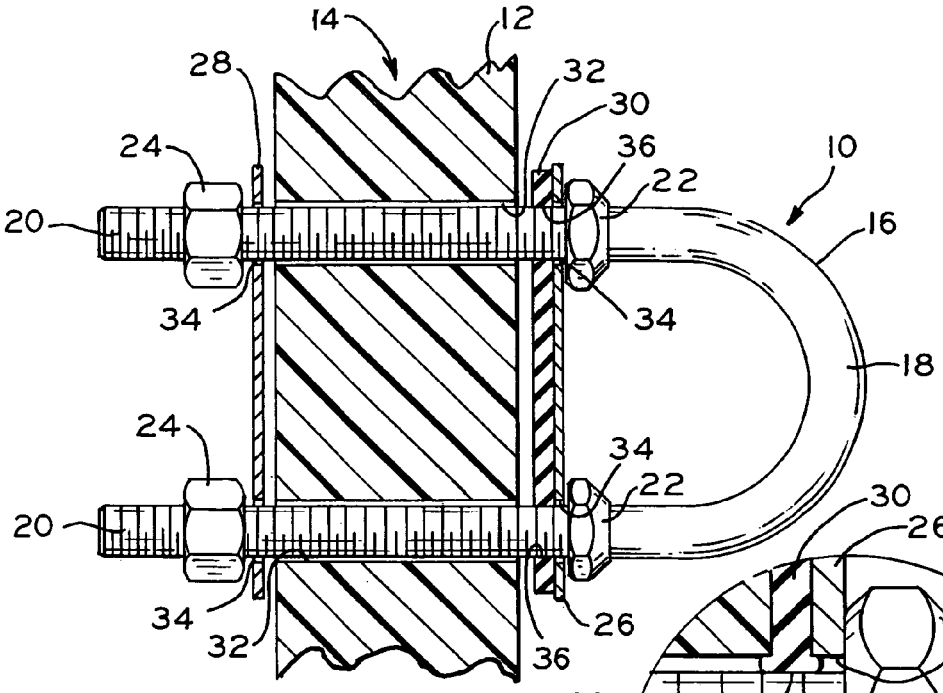
FIG. 5 is a sectional view of the bow eye of the present invention being mounted in the hull of a boat.
Figure 7:
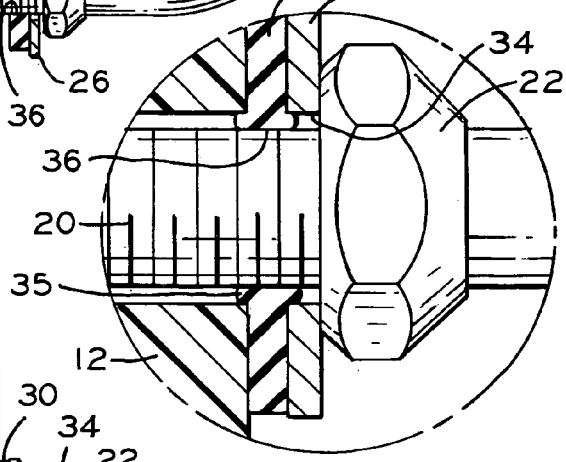
FIG. 7 is an exploded view of the circled area of FIG. 6 labeled FIG. 7.
Figure 6:
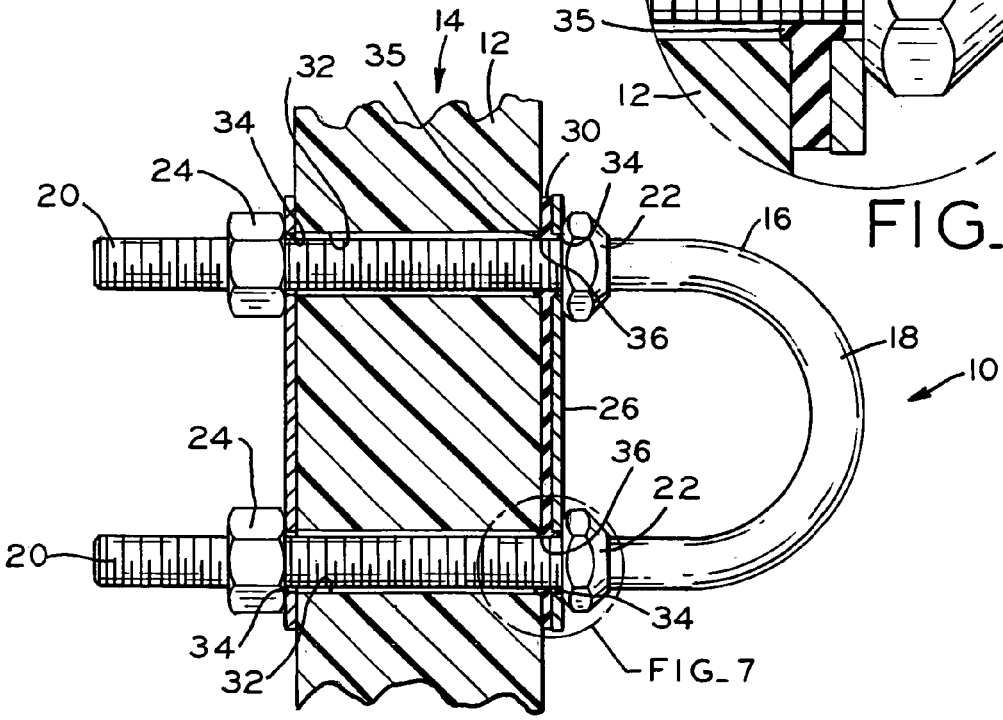
FIG. 6 is a sectional view of the bow eye of FIG. 5 in a tightened and sealed position.

Referring to FIGS. 5, 6, and 7, hull 12 of boat 14 has apertures 32 formed therein at the location where bow eye 10 is to be mounted. Apertures 32 are sized to receive legs 20 of U-shaped bolt 16. Legs 20 are threaded a distance that allows at least a portion of the threaded legs 20 to extend externally of hull 12, thus allowing the first pair of nuts 22 to be threadedly received on legs 20. A portion of threaded legs 20 extends beyond the internal wall of hull 12 also to receive the second pair of nuts 24. The length of the threaded portions of legs 20 may be greater than the typical thickness of hull 12 to accommodate varied thicknesses in hull 12 at different location on boat 14 or different boats. The threaded length of legs 20 also allows bow eye 10 to be mounted on an inclined surface as will be discussed further hereinbelow.

Referring to FIGS. 3 and 4, plates 26 and 28 are provided with apertures 34 located on opposite ends of the plates. Apertures 34 are positioned to align with and receive legs 20. Gasket 30 also has apertures 36 provided at both ends thereof that align with plate apertures 34 when gasket 30 is secured to plate 26. The diameter of apertures 32 in hull 12 and apertures 34 in plates 26 and 28 is larger than gasket apertures 36. Gasket apertures 36 have a slightly smaller diameter than the outer diameter of legs 20. When gasket 30 is forced onto legs 20 of bow eye 10, gasket 30 will pucker slightly. When the bow eye legs 20 are inserted into hull 12, the puckered portion of gasket 30 will at least partially fill apertures 32 in hull 12. Once the first and second pairs of nuts 22 and 24 are tightened, gasket 30 is forced further into hull apertures 32 to seal bow eye 10 in hull 12 (FIGS. 6 and 7). The thickness of gasket 30 may be varied as long as there is sufficient material to pucker into hull apertures 32 and plate apertures 34 to seal bow eye 10.

Figure 9:
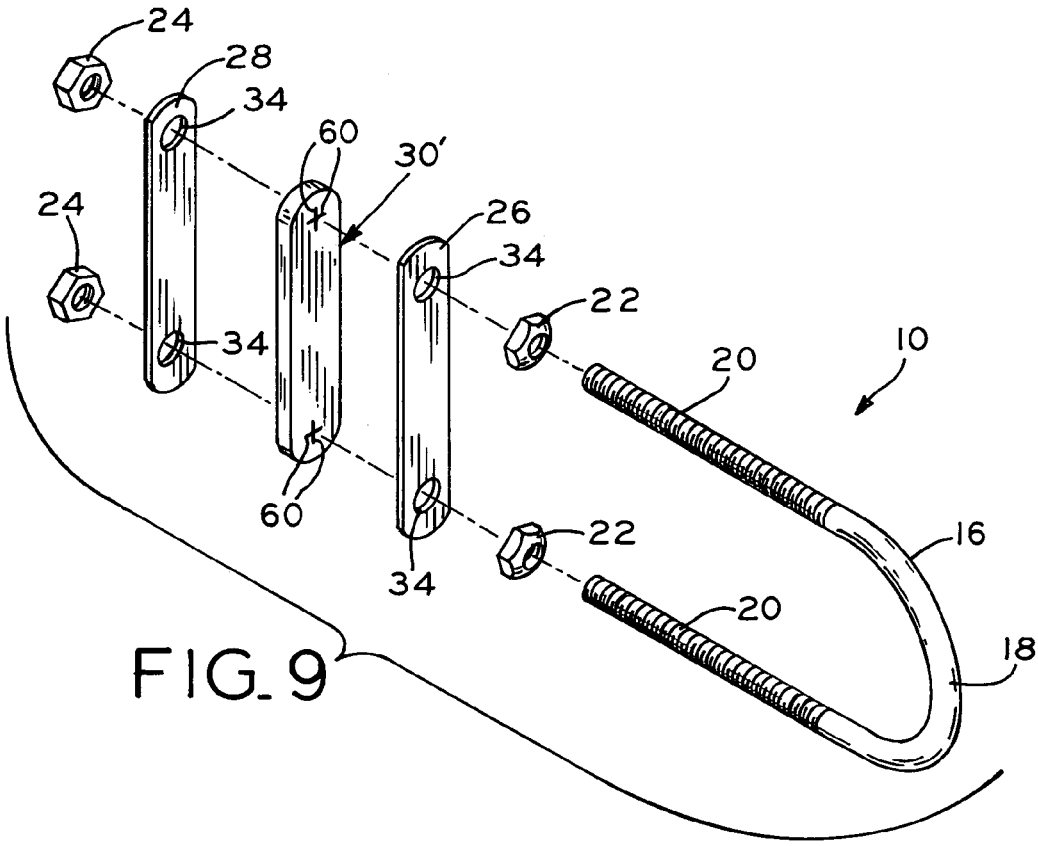
FIG. 9 is an exploded perspective view of the bow eye of FIG. 2 illustrating an alternative embodiment of the sealing gasket, prior to affixation of the sealing gasket to one of the bow eye plates.

Referring to FIG. 9, an alternative embodiment of gasket 30 is illustrated. Gasket 30' is provided with a pair of bisecting cuts 60 which form an "X." Bisecting cuts 60 replace apertures 36 in gasket 30. Cuts 60 each have a length substantially equal to the diameter of aperture 36. When gasket 30' is forced onto legs 20 of bow eye 10, the material between cuts 60 will extend outwardly creating an opening through which legs 20 pass. When the bow eye legs 20 are inserted into hull 12, the material portions defined between cuts 60 will at least partially fill apertures 32 in hull 12. In addition, since the length of cuts 60 is substantially equal to the diameter of apertures 36, the gasket material of gasket 30' in contact with legs 20 will pucker in a similar manner to that of gasket 30 described above. The puckered portion of gasket 30' also at least partially fills hull apertures 32.

Bow eye 10 is typically mounted to a flat, rigid surface of boat 14; however, bow eye 10 may be mounted to any surface of the boat. Bow eye 10 may be mounted to an inclined portion of hull 12. In this instance, one of each pair of nuts 22 and 24 may be adjusted along the threaded length of one leg 20 until plates 26 and 28 are tightened against hull 12 and gasket 30 fills hull apertures 32 and plate apertures 34.

During installation of bow eye 10, the first pair of nuts 22 is threaded onto legs 20 of U-bolt 16. First plate 26 having gasket 30 secured thereto is then positioned on legs 20 adjacent the first pair of nuts 22. Legs 20 are aligned with apertures 32 in hull 12 and bow eye 10 is positioned in hull 12. Alternatively, plate 26 having gasket 30 secured thereto may be located against the interior surface of the exterior wall of a hollow hull 12 for sealing the apertures in which bow eye 10 is mounted. Second plate 28 is placed on legs 20 and is positioned adjacent the interior surface of hull 12. The second pair of nuts 24 is then threaded onto legs 20 and tightened until bow eye 10 is secure against hull 12. The material 35 of gasket 30 then fills hull apertures 32 and first plate apertures 34 to seal bow eye 10 to hull 12.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A bow eye for mounting on a substantially rigid planar surface, said bow eye comprising:

a rigid U-shaped bolt having a pair of threaded legs;

at least one plate assembled with said legs, said at least one plate including a pair of plate apertures therein, said legs disposed in said plate apertures;

a sealing gasket secured to said plate, said gasket having a pair of gasket apertures therein, said gasket apertures aligned with said plate apertures, said plate apertures larger than said gasket apertures;

a first and second pair of nuts removably mounted on each of said legs, said first and second pairs of nuts for securing said U-shaped bolt to said planar surface, whereby said gasket is compressed and is sealingly secured to said bow eye and said surface, and a portion of said gasket sealingly fills said plate apertures.

2. The bow eye of claim 1, wherein said bow eye further includes a first plate and a second plate, said gasket secured to said first plate by an adhesive material.

3. In combination a bow eye mounted on a surface of watercraft, said bow eye comprising:

a rigid U-shaped bolt having a pair of threaded legs;

at least one plate mounted on said legs, said at least one plate including a pair of plate apertures therein, said legs disposed in said plate apertures;

a gasket adhesively secured to said plate, said gasket having a pair of gasket apertures therein, said gasket apertures aligned with said plate apertures, said plate apertures larger than said gasket apertures;

a first and second pair of nuts removably mounted on each of said legs;

a pair of apertures located in said surface of said watercraft, said legs received in said apertures, said first and second pairs of nuts securing said U-shaped bolt to said watercraft, whereby said gasket is sealingly compressed into said apertures and seals said apertures.

4. The bow eye of claim 3, wherein said bow eye further includes a second plate, said gasket is secured to first plate with an adhesive material.

5. The bow eye of claim 4, wherein said first plate is in contact with an exterior surface of said watercraft.

* * * * *